US005163733A

United States Patent [19]

Maxwell

[11] Patent Number: 5,163,733

[45] Date of Patent: * Nov. 17, 1992

[54] SEATING CLUSTER FOR AIRPORT WAITING AND SIMILAR AREAS

[76] Inventor: Joseph A. Maxwell, 100 Phillips Knob, Burnsville, N.C. 28714

[ * ] Notice: The portion of the term of this patent subsequent to Jan. 28, 2009 has been disclaimed.

[21] Appl. No.: 824,340

[22] Filed: Jan. 23, 1992

Related U.S. Application Data

[63] Continuation-in-part of Ser. No. 583,037, Sep. 14, 1990, Pat. No. 5,083,838.

[51] Int. Cl.[5] ..... A47C 15/00

[52] U.S. Cl. ..... 297/244; 297/232

[58] Field of Search ..... 297/244, 232, 248, 249, 297/135, 170, 121, 243

[56] References Cited

U.S. PATENT DOCUMENTS

D. 155,624 10/1949 Pahlmann ..... 297/248

3,266,840 8/1966 D'Estrube ..... 297/178

*Primary Examiner*—Kenneth J. Dorner
*Assistant Examiner*—Cassandra Hope
*Attorney, Agent, or Firm*—W. Thad Adams, III

[57] ABSTRACT

A seating cluster for airport and similar seating areas which includes a table for being positioned on a supporting surface, and eight seats attached to and supported by the table in spaced-apart relation to each other about the perimeter of the table in spaced-apart relation above the supporting surface thereby by defining a luggage storage area underneath the seat bottom. Each of the seats has a seat bottom having a front edge, opposed sides and a seat back. Each of the eight seats is attached to the table adjacent its respective inner side with the front of their respective seat bottoms positioned at an obtuse angle to the front of a seat bottom of a side adjacent seat whereby each seat and its respective side adjacent seat is angled slightly to each other to facilitate conversation by occupants.

15 Claims, 3 Drawing Sheets

SEATING CLUSTER FOR AIRPORT WAITING AND SIMILAR AREAS

This application is a continuation-in-part of application Ser. No. 583,037, filed on Sep. 14, 1990, and issued on Jan. 28, 1992 as U.S. Pat. No. 5,083,838.

TECHNICAL FIELD AND BACKGROUND OF THE INVENTION

This invention relates to a seating cluster for airport waiting and similar areas, and to a seating area formed from the clusters in a particular arrangement. While seating clusters according to the present invention may be used in bus stations, train stations, hotel waiting areas and other areas, reference to airport waiting areas will be used in this application merely for purposes of illustration. The invention results from studies into seating utilization in airport waiting areas, particularly at boarding gates. Such waiting areas are generally designed with a number of rows of seats. There may be as many as 20 or 30 seats in a row, with five to 10 rows to provide sufficient seating to accommodate passengers awaiting embarkation. Adjacent rows are usually back-to-back, so that a long row of occupants face an equally long row of occupants across a narrow aisle. Generally, these rows of seats are designed to that occupants share arm rests. This creates a situation where either one occupant takes up the entire arm rest, or adjacent occupants jockey their arms and elbows to acquire arm rest space.

Studies have shown that even in crowded airports, only about 60% of the seats in the prior art types of seating area arrangements are actually used for seating. This results from the fact that approximately 70% of all airline passengers are travelling alone and prefer not to sit in very close proximity to strangers. The rest of the seats are used to hold luggage or to provide space between passengers, particularly strangers. It has been observed that many passenger will stand off to the side of the seating area or in aisles rather than sit immediately next to strangers. In addition, these prior art seating areas usually do not provide space for luggage to be placed near the owner. If the luggage is not placed in a nearby seat thereby depriving another of a place to sit, the luggage will be placed in or at the end of an aisle, creating obstacles to free movement within the area and the possibility for stumbling and tripping of passengers over the obstacles.

If these problems are addressed at all, it generally involves providing larger areas. However, it has been observed that adding additional seats does not solve the problem, since only 60% of any added seats will generally be occupied. Interaction between individuals in public places, particularly strangers, is controlled by deeply ingrained customs of which individuals are usually not even aware. Concepts such as "space" and an avoidance of touching between and among individuals in public places have not been adequately recognized or taken into account. For various reasons these factors seem to be more important to Americans than to many other nationalities.

Prior art seating areas for airports also do not accommodate needs and preferences of families, friends and business associates traveling together. Most passengers traveling with acquaintances travel in groups of two. In prior art seating areas, such individuals are forced either to sit next to each other looking straight ahead, or across an aisle from each other. If sitting next to each other, they must turn towards each other to comfortably establish eye contact needed for conversation. If sitting across a relatively wide aisle from each other, they must speak over the conversation of others and at a volume which eliminates any privacy. Since each low row of seats has an equally long aisle between it and an adjacent row, with only two ends of the row for exiting, there is a continual flow of traffic between the seats, making conversation even more difficult.

Prior art seating arrangements most often do not provide any nearby table areas for food or drinks, newspapers or magazines, or for telephones, reading lights, ash trays or other conveniences. Very often, seat occupants place drink cups and food on the floor near the seat. These get kicked over, creating unsanitary conditions and increasing maintenance and replacement costs. Prior art seating arrangements also do not provide access or parking facilities for wheelchairs.

For all of these reasons, a new concept in public seating has been developed which solves these problems. In so doing, it is believed that more compact seating areas can be designed which will nevertheless respect privacy and result in more comfortable short term seating.

SUMMARY OF THE INVENTION

Therefore, it is an object of the invention to provide a seating cluster which provides a compact seating area for public areas such as airport waiting areas.

It is another object of the invention to provide a seating cluster which provides an area for luggage storage adjacent the seat where the owner is seated without using another seat.

It is another object of the invention to provide a seating cluster which provides a seating arrangement for two individuals traveling together to face each other at an angle comfortable for private conversation.

It is another object of the invention to provide a seating cluster which provides ample space for passengers feet.

It is another object of the invention to provide a seating cluster which increases seating occupancy rates.

It is another object of the invention to provide a table next to each seat in a seating cluster for occupant use.

It is another object of the invention to provide a seating cluster which can be arranged in a geometric pattern which provides luggage storage space, foot space, adequate aisles for passage and space or proximity between passengers according to preference.

It is another object of the invention to provide a seating cluster which has segmented parts which can be separated if necessary to fill in odd-shaped areas such as corners.

It is another object of the invention to provide a seating cluster which provides aisles permitting entry and exit in several different directions and by several different paths.

It is another object of the invention to provide a seating cluster which provides two arm rests for each seat occupant.

It is another object of the invention to provide a seating cluster which can be securely positioned without permanent attachment to the floor, for ease of movement for re-arrangement or when cleaning or maintaining the floor.

It is another object of the invention to provide a seating cluster which, when combined with at least one or more other like seating clusters permits conversation between up to eight individuals, all of whom are facing each other at a comfortable distance from each other.

It is another object of the invention to provide a seating cluster, which, when arranged in a grouping provides space for wheelchair parking without blocking aisle access.

It is another object of the invention to provide a seating cluster which can be broken down into a cluster having either two or four seats.

These and other objects of the present invention are achieved in the preferred embodiments disclosed below by providing a seating cluster for airport and similar seating areas which includes a table for being positioned on a supporting surface, eight seats attached to and supported by the table in spaced-apart relation to each other about the perimeter of the table in spaced-apart relation above the supporting surface thereby by defining a luggage storage are underneath the seat bottom. Each of the seats has a seat bottom having a front edge, opposed sides and a seat back. Each of the eight seats is attached to the table adjacent their respective inner side with the front of their respective seat bottoms positioned at an obtuse angle to the front of a seat bottom of a side adjacent seat whereby each seat and its respective side adjacent seat is angled slightly to each other to facilitate conversation by occupants. The outer side of the each of the seats is adapted to define an aisle for occupant passage.

Each of the eight seats is positioned seat back-to-seat back with a rear adjacent seat whereby occupants of each seat and the rear adjacent seat is seated substantially back-to-back. The seat backs of the each seat and the rear adjacent seat define an acute angle relative to each other.

According to one preferred embodiment of the invention, the sides of each of the seats and the rear adjacent seat are obtusely angled to each other to define a recessed area for placement of personal possessions such as luggage.

According to another preferred embodiment of the invention, the table comprises a centrally disposed four-sided table segment, and four triangular-shaped table segments having a side adjacent a respective one of the four-sides of the four-sided table segment extending between adjacent pairs of side-by-side seats.

According to yet another preferred embodiment of the invention, the table has separable identical seating cluster segments attached to the centrally disposed four-sided table segment.

According to one preferred embodiment of the invention, two seats are attached to each of the four joined interior sides in back-to-back relation to each other.

According to another preferred embodiment of the invention, each of the four joined interior sides is planar.

According to yet another preferred embodiment of the invention, each of the four table sides is at substantially right angles to each other.

According to one preferred embodiment of the invention, a seating area for airports and similar facilities is provided. The seating area a plurality of geometrically placed, spaced-apart seating clusters. Each of the seating clusters comprises a table for being positioned on a supporting surface, and eight seats are attached to and supported by the table in spaced-apart relation to each other about the perimeter of the table in spaced-apart relation above the supporting surface thereby defining a luggage storage area underneath the seat bottom. Each of the seats has a seat bottom having a front edge, opposed inner and outer sides and a seat back. Each of the eight seats is attached to the table adjacent their respective inner sides with the front of their respective seat bottoms positioned at an obtuse angle to the front of a seat bottom of a side adjacent seat. Each seat and its respective side adjacent seat is angled slightly to each other to facilitate conversation by occupants, the outer side of the each of the seats is adapted to define an aisle for occupant passage.

Each of the eight seats is positioned seat back-to-seat back with a rear adjacent seat whereby occupants of each seat and the rear adjacent seat are seated substantially back-to-back. The seat backs of the each seat and the rear adjacent seat define an acute angle relative to each other.

According to another preferred embodiment of the invention, the sides of each of the seats and the rear adjacent seat are obtusely angled to each other to define a recessed area for placement of personal possessions such as luggage.

According to yet another preferred embodiment of the invention, the table comprises a centrally disposed four-sided table segment, and four triangular-shaped table segments. Each of the triangular table segments has a side adjacent a respective one of the four-sides of the four-sided table segment which extends between adjacent pairs of side-by-side seats.

According to yet another preferred embodiment of the invention, the table has four joined interior sides to define a rectangular-shaped table.

According to yet another preferred embodiment of the invention, each of the three primary sides is substantially planar.

According to yet another preferred embodiment of the invention, each of the three primary sides comprises first and second side segments obtusely angled relative to each other.

According to yet another preferred embodiment of the invention, the triangle-shaped table is equilateral.

According to yet another preferred embodiment of the invention, the geometrical placement of the seating clusters comprises a plurality of arranged seating clusters. In a first direction the seating clusters extend along a first straight line, and in a second direction the seating clusters extend along a second straight line diagonal to the first straight line. The spaces between adjacent seating clusters comprise aisles.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
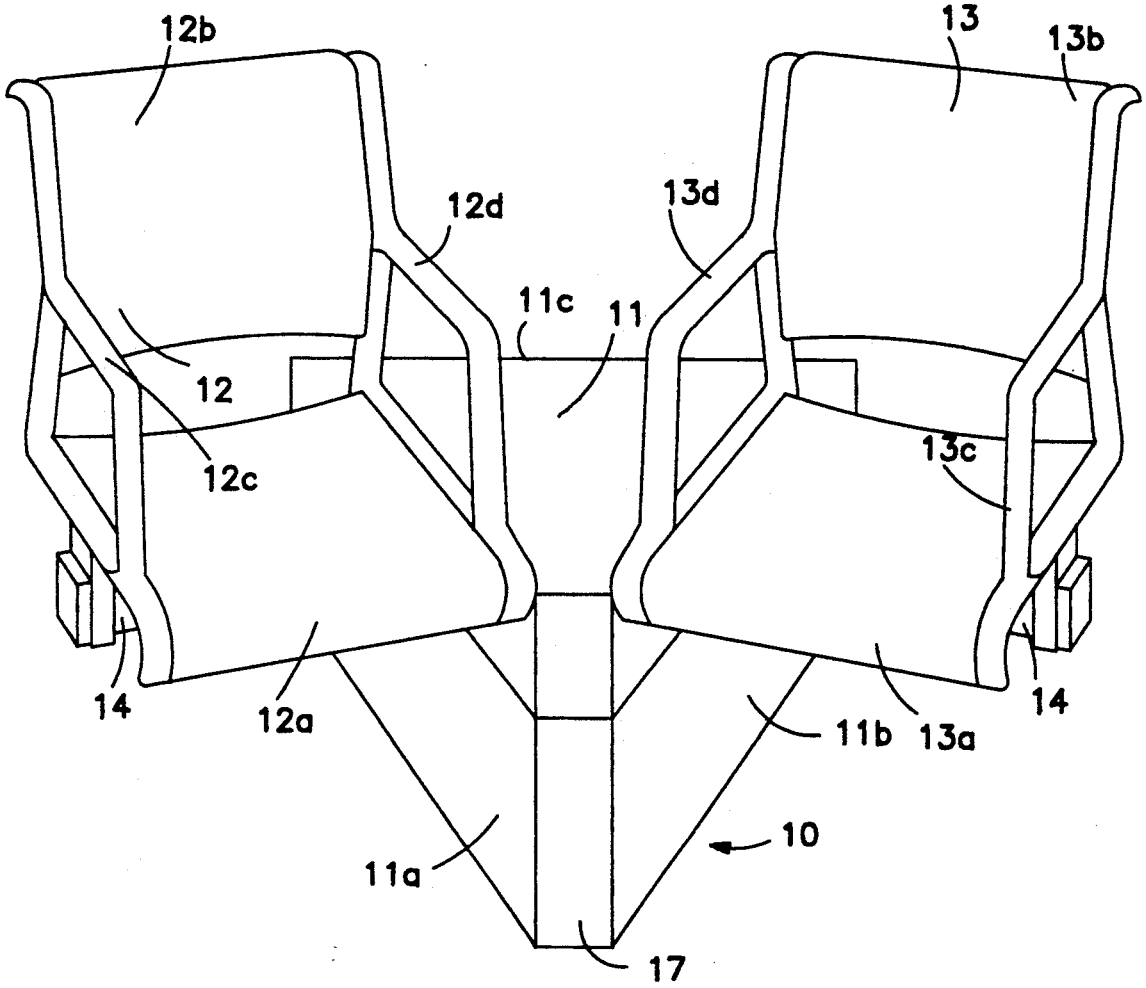
FIG. 1 is a perspective view of a two-seat segment of the seating cluster according to a preferred embodiment of the invention.

Referring now specifically to the drawings, a two-seat segment of a seating cluster according to the present invention is illustrated in FIG. 1 and shown generally at reference numeral 10. Seating cluster 10 includes a triangularly-shaped table 11. Table 11 is formed as a low, solid box which sits directly on a supporting floor surface. Table 11 may be decorated to complement the overall decor of the seating area, including carpet or fabric coverings. First and second seats 12 and 13 are supported adjacent to table 11 above the supporting floor surface by a supporting post 14 which extends outwardly from table 10 and underneath each of the seats 12 and 13, and onto which seats 12 and 13 are respectively mounted. This arrangement provides a completely open space beneath each seat 12 and 13 for luggage storage and to permit complete and easy cleaning.

Figure 2:
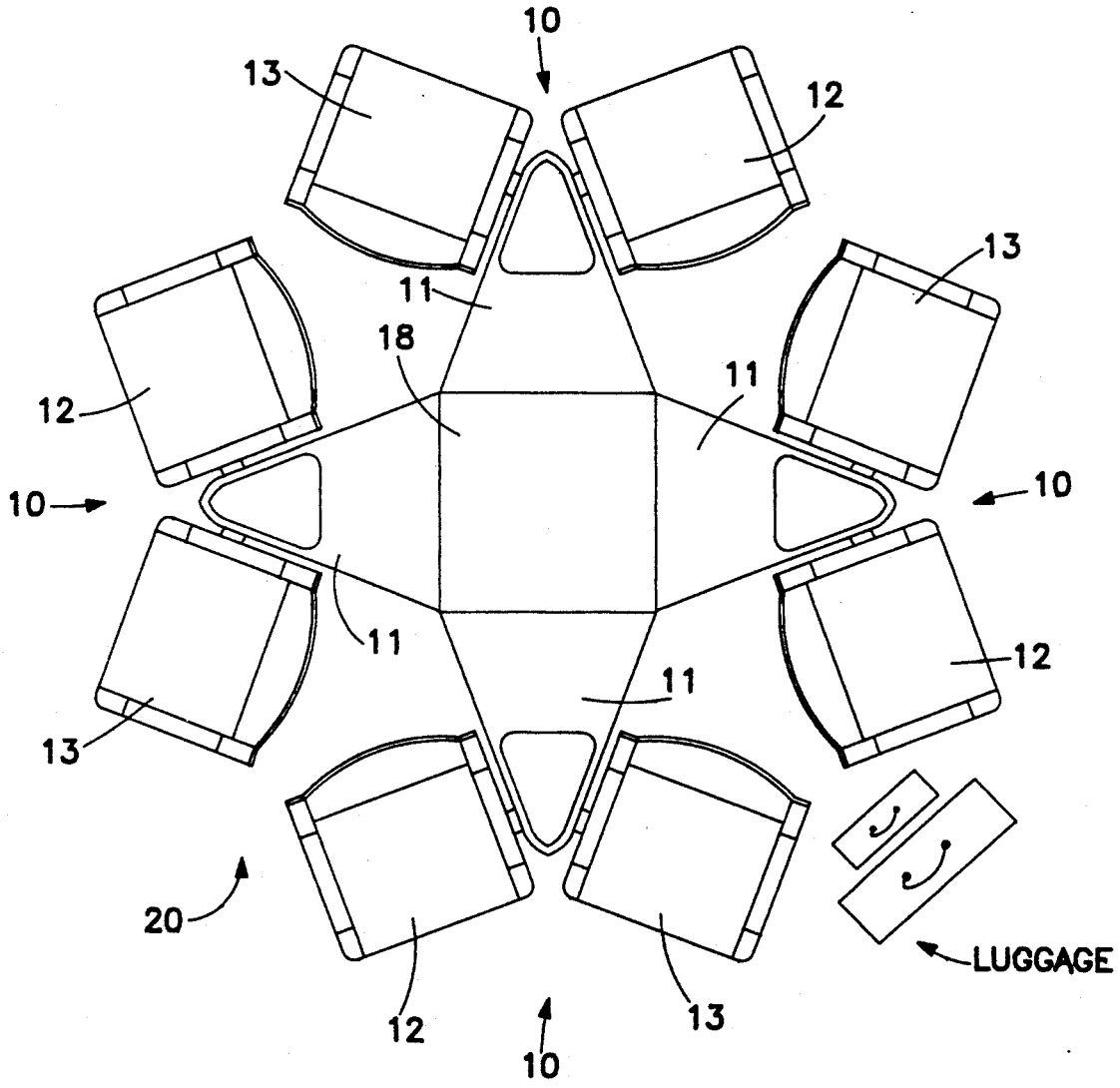
FIG. 2 is a top plan view of four of the two seat segments assembled to form a seating cluster substantially as shown in FIG. 1.
Figure 3:
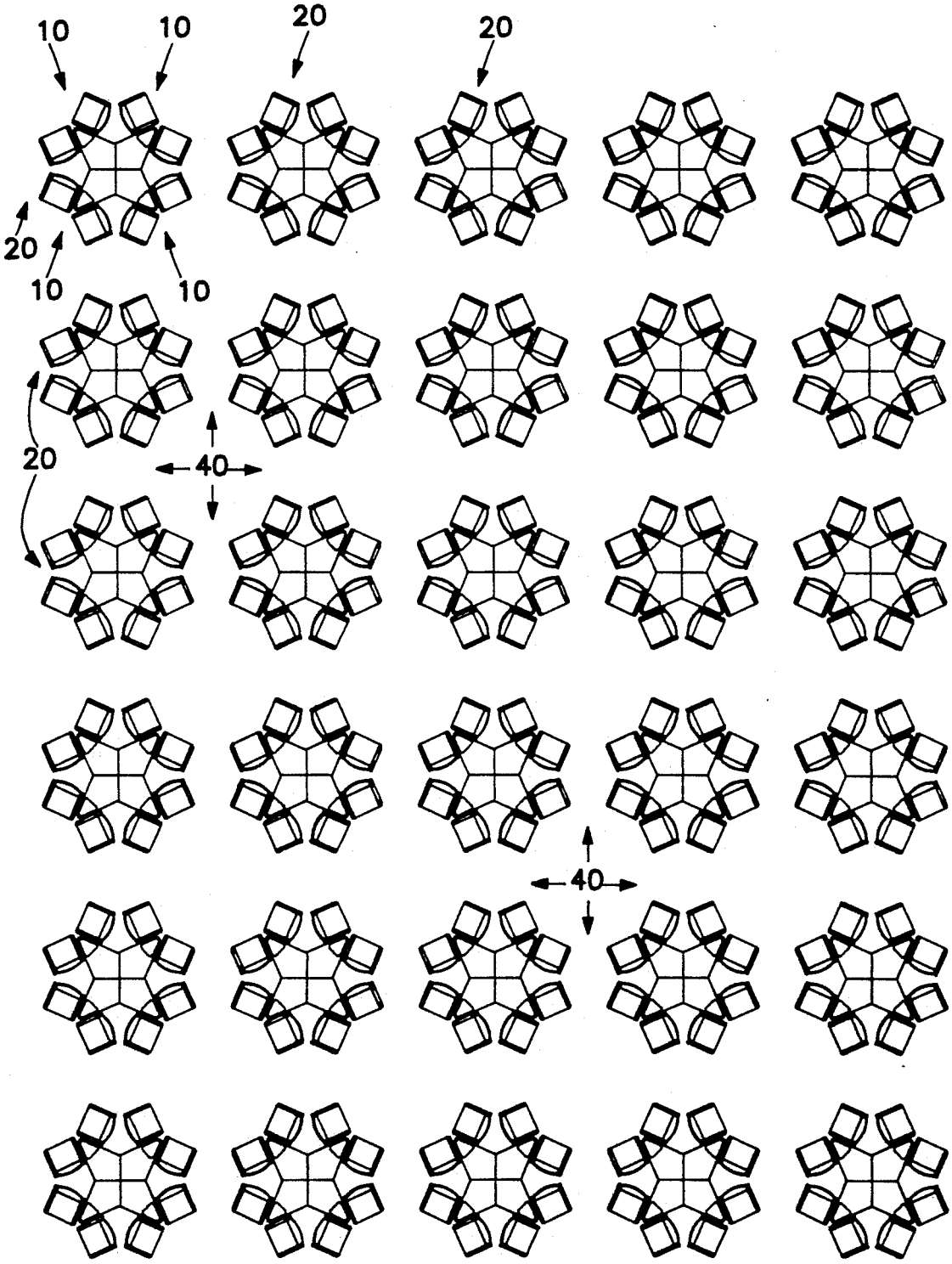
FIG. 3 is a seating area formed of a plurality of seating clusters as shown in FIG. 2.

Table 11 is substantially triangular in shape having three sides 11*a*, 11*b* and 11*c*. The front, or "nose" 17 of table 11 may be squared off, as shown in FIG. 1, or rounded as shown in FIGS. 2 and 3. The squared-off nose shown in FIG. 1 does to affect the overall triangular shape of the table 11.

Referring now to FIG. 2, four of the seating segments 10 are connected to a single, centrally-disposed rectangular table 18 by their respective sides 11*c* to define a seating cluster 20. Seats 12 and 13 are attached to sides 11*a* and 11*b*, respectively, of the respective table 11 in a manner as to define a very shallow obtuse angle with respect to each seat 12 or 13 and a respective seat 12 or 13 of an adjacent seat segment 10. The areas formed by these shallow angles provide sufficient space to place several pieces of luggage without interfering with or encroaching on the aisles.

Each of the seats 12 and 13 has a seat bottom 12*a*, 13*a*, respectively; a seat back 12*b*, 13*b*, respectively, and two opposed arm rests 12*c*, 12*d*, 13*c*, 13*d*.

The geometry of the seating cluster 20 provides two distinct types of paired groupings of seats. One paired grouping comprises, for example, any seat and a first other seat which it backs up to, so that occupants of these seats will be back-to-back to each other. These seats could be occupied by strangers with a feeling of privacy from each other despite relatively close proximity, particularly since each seat is separated from every other seat by a portion of the table 11.

Another grouping of the seats comprises any seat and a second other seat which it is angled towards so that the front of the seat bottoms are at a shallow, obtuse angle to each other. These groupings are attached to the same table 11. One such grouping is shown in FIG. 1. These seats can be occupied by passengers traveling together. The occupants face slightly towards each other for ease of conversation and are close enough for private conversation at a moderate voice level. Again, the table 11 provides enough distance between adjacent seat occupants to permit comfortable conversation. Furthermore, table 11 provides sufficient distance between the seats so that strangers consider the each seat to be a single seat.

Table 11 is adaptable to variety of uses. Lamps, ash trays, telephones, cup holders and the like can be provided for the occupants. A raised rim around the periphery of the table 11 can be added to contain spills. Up-directed lighting can be incorporated into the center of each table to provide reading light. When necessary or desireable, either one, two or three tables 11 with attached seats 12 and 13 can be placed in corners, against walls or in other places where the full seat cluster 20 will not fit. These seat segments 10 fill odd-sized and undersized spaces, and provide more room along aisles. This is particularly important as a means of providing access for wheelchairs and extra space for people with disabilities, those with baby strollers, large luggage carriers or several bags. Wheelchairs and baby strollers can be easily moved though the aisles and parked in one of the recesses next to another seat. Each separate seating cluster 20 provides a suitable space for parking a wheelchair or the like.

As is shown in FIG. 3, seating clusters 20 are placed in a geometric pattern which provides aisles 40. The spacing between seating cluster 20 and the positioning of seating clusters 20 with reference to each other can be varied to alter the width of the aisles and to make the aisles more or less straight.

A seat segment, a seating cluster formed from a plurality of seating segments and a seating area formed of a plurality of seating clusters are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A seating cluster for airport and similar seating areas, comprising:

(a) a table for being positioned on a supporting surface;

(b) eight seats attached to and supported by the table in spaced-apart relation to each other about the perimeter of the table in spaced-apart relation above the supporting surface thereby defining a luggage storage area underneath the seats, each of said seats having a seat bottom having a front edge, opposed inner and outer sides and a seat back;

(c) each of said eight seats attached to said table adjacent their respective inner side with the front of their respective seat bottoms positioned at an obtuse angle to the front of a seat bottom of a side adjacent seat whereby each seat and its respective side adjacent seat is angled slightly to each other to facilitate conversation by occupants, and the outer side of the each of said seats is adapted to define an aisle for occupant passage; and (d) each of said eight seats positioned seat back-to-seat back with a rear adjacent seat whereby occupants of each seat and the rear adjacent seat are seated substantially back-to-back, the seat backs of said each seat and said rear adjacent seat defining a acute angle relative to each other.

2. A seating cluster according to claim 1, wherein the sides of each of said seats and said rear adjacent seat are obtusely angled to each other to define a recessed area for placement of personal possessions such as luggage.

3. A seating cluster according to claim 1, wherein said table comprises a centrally disposed four-sided table segment, and four triangular-shaped table segments having a side adjacent a respective one of the four-sides of the four-sided table segment and extending between adjacent pairs of side-by-side seats.

4. A seating cluster according to claim 3, wherein said table has separable identical seating cluster segments attached to said centrally disposed four-sided table segment.

5. A seating cluster according to claim 4, wherein two seats are attached to each of the four triangular-shaped table segments in back-to-back relation to each other.

6. A seating cluster according to claim 5, wherein each of said four joined interior sides is planar.

7. A seating cluster according to claim 6, wherein each of said four table sides is at substantially right angles to each other.

8. A seating area for airports and similar facilities, said seating area comprising a plurality of geometrically placed, spaced-apart seating clusters, each of said seating clusters comprising:

(a) a table for being positioned on a supporting surface;

(b) eight seats attached to and supported by the table in spaced-apart relation to each other about the perimeter of the table in spaced-apart relation above the supporting surface thereby defining a luggage storage area underneath the seats, each of said seats having a seat bottom having a front edge, opposed inner and outer sides and a seat back;

(c) each of said eight seats attached to said table adjacent their respective inner sides with the front of their respective seat bottoms positioned at an obtuse angle to the front of a seat bottom of a side adjacent seat whereby each seat and its respective side adjacent seat is angled slightly to each other to facilitate conversation by occupants, the outer side of the each of said seats is adapted to define an aisle for occupant passage;; and (d) each of said eight seats positioned seat back-to-seat back with a rear adjacent seat whereby occupants of each seat and the rear adjacent seat are seated substantially back-to-back, the seat backs of said each seat and said rear adjacent seat defining an acute angle relative to each other.

9. A seating area according to claim 8, wherein the sides of each of said seats and said rear adjacent seat are obtusely angled to each other to define a recessed area for placement of personal possessions such as luggage.

10. A seating area according to claim 8, wherein said table comprises a centrally disposed four-sided table segment, and four triangular-shaped table segments, each of said triangular table segments having a side adjacent a respective one of the four-sides of the four-sided table segment and extending between adjacent pairs of side-by-side seats.

11. A seating area according to claim 10, wherein said table has four joined interior sides to define a four-sided table.

12. A seating area according to claim 11, wherein each of said three primary sides is substantially planar.

13. A seating area according to claim 10, wherein each of said three primary sides comprises first and second side segments obtusely angled relative to each other.

14. A seating area according to claim 10, wherein said triangle-shaped table is an isosceles triangle.

15. A seating area according to claim 8, wherein said geometrical placement of said seating clusters comprises a plurality of arranged seating clusters, wherein in a first direction said seating clusters extend along a first straight line and in a second direction said seating clusters extend along a second straight line diagonal to said first straight line, and further wherein the spaces between adjacent seating clusters comprise aisles.

* * * * *